United States Patent [19]

Oberstadt

[11] 3,938,479

[45] Feb. 17, 1976

[54] EXHAUST GAS SENSOR OPERATING TEMPERATURE DETECTION SYSTEM

[75] Inventor: Allan L. Oberstadt, Rochester, Mich.

[73] Assignee: The Bendix Corporation, Southfield, Mich.

[22] Filed: Sept. 30, 1974

[21] Appl. No.: 510,276

[52] U.S. Cl. ..... 123/32 EA; 73/116

[51] Int. Cl.[2] ..... F02B 3/00

[58] Field of Search ..... 73/118, 117.3, 116; 60/276; 123/32 EA; 307/117

[56] References Cited

UNITED STATES PATENTS

| | | | |
|---|---|---|---|
| 3,745,768 | 7/1973 | Zechnall et al. | 60/276 |
| 3,784,843 | 1/1974 | Gustus | 307/117 |

*Primary Examiner*—Herbert Goldstein
*Assistant Examiner*—Anthony V. Ciarlante
*Attorney, Agent, or Firm*—Russel C. Wells

[57] ABSTRACT

In a fuel management system having an exhaust gas sensor located in an exhaust gas system of an internal combustion engine for controlling the fuel air ratio of the fuel mixture to the internal combustion engine, a detection system for detecting when the operating temperature of the exhaust gas sensor is within its normal operating range. In the preferred embodiment, an oxygen gas sensor having a voltage output above a first threshold level in a rich fuel mixture and a voltage output below a second threshold level in a lean fuel mixture is used for controlling the fuel air mixture to the internal combustion engine. When the oxygen gas sensor is below its normal operating temperature, the internal impedance of the sensor is such that the voltage generated by the sensor through its amplifier is extremely high. The detection system compares a timed developed output of the sensor to a temperature reference voltage and supplies a signal to enable the control function of the sensor when operating within its normal temperature range.

7 Claims, 3 Drawing Figures

EXHAUST GAS SENSOR OPERATING TEMPERATURE DETECTION SYSTEM

BACKGROUND OF THE INVENTION

1. Field of the Invention

This invention relates to gas sensor operating systems in general and more particularly to exhaust gas sensors operating in a fuel injection system for determining when the operating temperature of the sensor is within its normal operating range.

2. Description of the Prior Art

In a preferred embodiment wherein an oxygen gas sensor is positioned in the exhaust system of an internal combustion engine for generating an output signal for controlling the air fuel ratio of the fuel mixture supplied to the engine, the sensor must be above a certain temperature in order to operate properly. If the oxygen gas sensor is below this temperature, the sensor operation is abnormal resulting in the internal combustion engine operating unsatisfactorily.

When an oxygen gas sensor in the exhaust system is operating below its operating temperature typically after a cold start or during a prolonged idle condition, its impedance is or will become very high. However during normal temperature operations its impedance decreases to a low value.

Several prior art control systems are used to control the output of the exhaust gas sensor circuit during the cold operation. One control system disables the output of the exhaust gas sensor when the engine coolant temperature is below a predetermined temperature level. In this system it is assumed that when the engine coolant temperature becomes sufficiently warm, the exhaust gas temperature is sufficiently high to heat the oxygen gas sensor to its operating temperature.

Another system is based strictly on a time signal. The timing circuit is initiated from the turn on of an ignition key and at the end of the predetermined time it is assumed that the exhaust gas sensor is at its operating temperature. The disadvantage of this particular system is that the time is an arbitrary value and is not able to cover all engine operations. In particular, in either of the above two systems if the internal combustion engine is operated at an idle condition for a sufficiently long period of time the operating temperature of the sensor would decrease and yet neither of the two systems would be able to detect the sensor temperature decreasing.

SUMMARY OF THE INVENTION

In the system to be described herein the system is responsive to the voltage changes during the operation of the gas sensor. If there are no voltage changes the gas sensor is determined by the system to be cold and the control circuit for the exhaust gas sensor is not allowed to control the fuel management system.

It is a principal object of the invention to monitor the operation of the exhaust gas sensor and allow it to control the fuel management system only when the sensor is within its normal temperature operating range.

It is another object of this invention to detect the operating temperature of an exhaust gas sensor by monitoring its output signals and not by any arbitrary engine operation or for a predetermined interval of time.

It is another object of this invention to provide a control system for monitoring the operating temperature of an exhaust gas sensor wherein the system automatically adjusts for any hot start condition of an internal combustion engine.

These and other objects of the invention will be understood from the following detailed description and drawings of a detection system for detecting the operating temperature of an exhaust gas sensor. The exhaust gas sensor is electrically connected to an amplifying circuit means for generating an output when the internal impedance of the sensor is reduced due to the heating of the sensor. The output of the amplifying circuit means is a voltage signal having a low voltage level when the sensor responds to the absence of a particular predetermined constituent gas in the exhaust gas and having a high voltage level when the sensor responds to the presence of a particular predetermined constituent gas. Electrically connected to the output of the amplifier means is a capacitor having a series resistance controlling the charging rate of the capacitor. The capacitor charges to the voltage magnitude the high voltage level output of said amplifier circuit means. The capacitor is discharged through a discharging control circuit when the output of the amplifier circuit means is at the low voltage level. Additionally the output of the capacitor is electrically connected to the inverting input of a comparator. The noninverting input of the comparator is electrically connected to a reference voltage representing the operating temperature of the sensor. A comparator compares the voltage level of the capacitor with the reference voltage and when the capacitor voltage exceeds the reference voltage the output of the comparator is an enabling signal for enabling the controlling function of the exhaust gas sensor.

DETAILED DESCRIPTION

Figure 1:
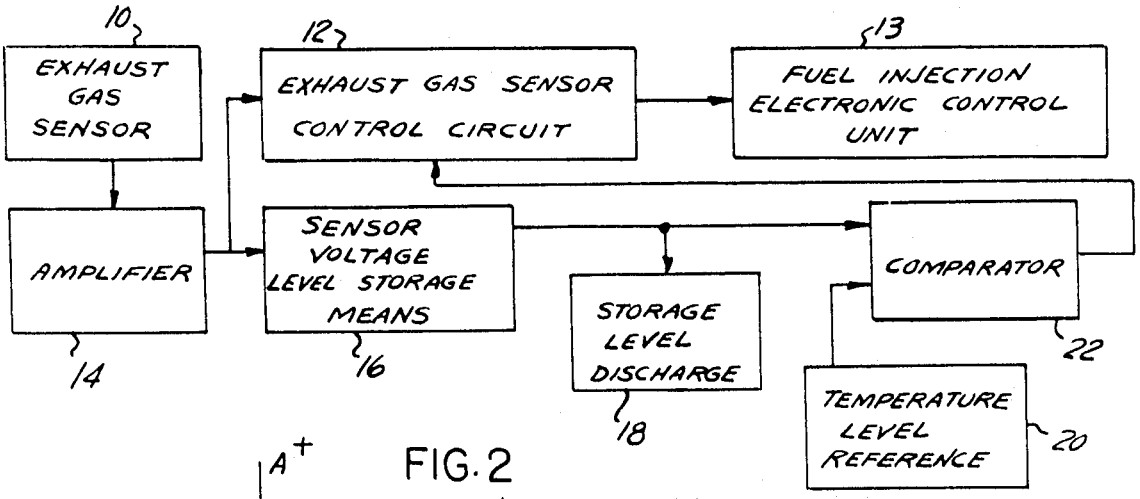
FIG. 1 is a block diagram of the temperature detection system for an exhaust gas sensor.
Figure 2:
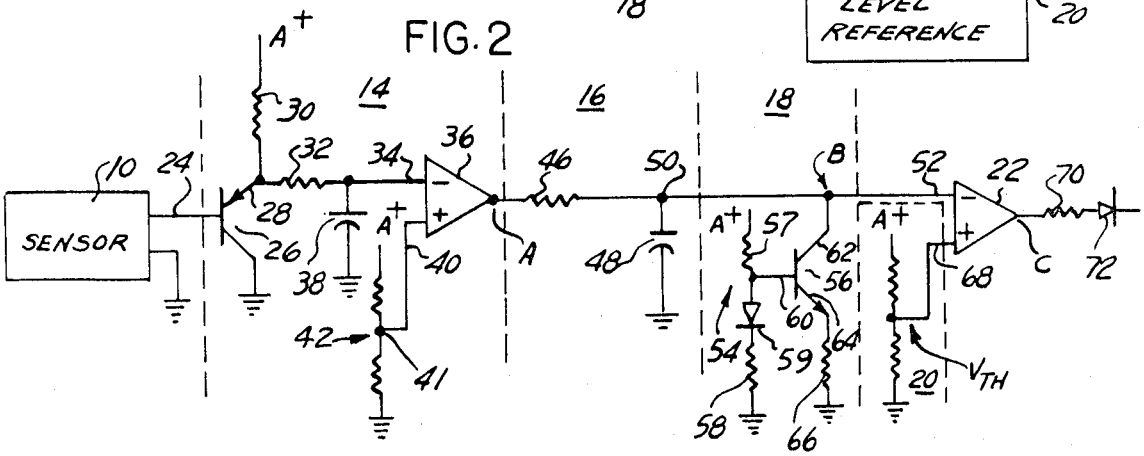
FIG. 2 is a schematic of the system of FIG. 1.

Referring to the Figs. by the characters of reference there is illustrated in FIG. 1 a block diagram of the system for detecting when an exhaust gas sensor 10 is operating within its normal operating temperature range. The output of the system point C in FIG. 2 is a signal for allowing the exhaust gas sensor 10 to control a fuel management system 12 and 13 only when the sensor 10 is within its operating temperature range.

The system of FIG. 1 as used in a fuel management system for an internal combustion engine comprises an exhaust gas sensor 10, an exhaust gas sensor amplifier circuit 14, a storage means 16, a storage discharge means 18, a temperature level reference means 20, and a comparator 22. The output of the comparator is an electrical signal controlling the exhaust gas sensor control circuit 12 in the fuel management system.

The exhaust gas sensor 10 in the preferred embodiment is an oxygen gas sensor for sensing the presence of oxygen in an exhaust gas of an internal combustion engine. The oxygen gas sensor 10 generates a first voltage signal greater than a predetermined threshold level in the absence of oxygen and a second voltage signal less than a predetermined threshold level in the presence of oxygen when operating in its normal temperature range.

One property of an oxygen gas sensor is that at temperatures below the normal operating temperature, the internal impedance of the sensor is extremely high. As the temperature of the sensor warms up to its normal operating temperature, the internal impedance of the sensor drops from its extemely high value of approximately 100 megohms to its operating impedance on the order of one or two thousand ohms. In the exhaust system of an internal combustion engine, the normal operating temperature of the sensor is on the order of 600° to 700° F. and when the temperature goes below this level, the control function voltage of the exhaust gas sensor cannot be used in a fuel management system.

The oxygen gas sensor operating at or above the normal operating temperature, will generate in the absence of oxygen gas a signal above the threshold level. Typically, the first voltage signal level is approximately 800 millivolts. In the presence of oxygen, the exhaust oxygen gas sensor will generate a second voltage signal of approximately 75 millivolts.

Referring to FIG. 2 the schematic of a control system of FIG. 1, the output of the sensor 10 is connected to the base lead 24 of a PNP transistor 26. The emitter lead 28 of the transistor 26 is electrically connected through a resistor 30 to a source of voltage A+. As previously indicated when the temperature of the sensor 10 is below its normal operating temperature, its internal impedance is very high. This high impedance coupled with the very small base current from the transistor 26 will develop a voltage signal at the emitter 28 of the transistor approximating the voltage source A+. As the sensor 10 warms up its internal impedance decreases and the voltage on the emitter 28 of the transistor 26 likewise decreases.

The emitter 28 of the transistor 26 is electrically connected through another resistor 32 to the inverting input 34 of a comparator 36. A capacitor 38 is also electrically connected to the inverting input 34 and ground and functions with the resistor 32 forming a filter network.

Electrically connected to the noninverting input 40 of the comparator 36 is a voltage reference 41 which is generated by means of a voltage divider 42 connected to the source of voltage A+. This voltage reference 41 is equal to a voltage level intermediate the two voltage signal levels of the sensor 10 and is the predetermined threshold level. The output signal of the comparator 36 is a waveform signal 44 similar to that shown in the waveshape A of FIG. 3. This signal 44 is substantially a rectangular waveshape switching between a high and a low voltage level. The output signal 44 of the comparator 36 when the sensor 10 is below its operating temperature is at the low level. When the voltage output of the comparator 36 is at the high voltage level the input to the comparator 36 on the inverting input 34 is below the threshold voltage 41 on the noninverting input 40.

The output signal 44 of the comparator 36 is electrically connected to the storage means 16 comprising a resistor 46 and a capacitor 48 network. When the output of the comparator 36 is high, the capacitor 48 begins to charge through the resistor 46 to the output of the comparator 36. The charging time constant is extremely long, such that the capacitor 48 is not charged up to the second voltage level until some period of time has lapsed. The junction 50 between the resistor 46 and the capacitor 48 is connected to a storage discharge means 18 and to the inverting input 52 of the comparator 22.

The storage level discharge means 18 comprises a constant current source 54 and a transistor 56 as illustrated in FIG. 2. The constant current source 54 is a series circuit comprising a pair of resistors 57 and 58 and a diode 59 electrically connected between the source of voltage A+ and ground. The anode of the diode 59 is electrically connected to the base lead 60 of the transistor 56 which in the preferred embodiment is a NPN transistor. The collector lead 62 of the NPN transistor is electrically connected to the capacitor 48 and to the inverting input 52 of the comparator 22. The emitter lead 64 of the transistor 56 is electrically connected through a resistor 66 to ground.

The constant current source 54 supplys a predetermined amount of current to the base lead 60 of the transistor 56 to control the discharge of the capacitor 48. The time constant for the discharge of the capacitor 48 is determined by the size of the emitter resistor 66 and the amount of base current supplied by the constant current source 54.

The comparator 22 has its inverting input 52 electrically connected to the capacitor 48 and its noninverting input 68 is supplied with a temperature reference voltage signal $V_{th}$ generated from a voltage divider means connected across the source of supply and ground. The value of the voltage signal $V_{th}$ generated by the voltage divider is a voltage equivalent to or proportional with the normal operating temperature of the sensor.

The output of the comparator 22 is a normally high voltage signal 69 until the voltage level at the inverting input 52 exceeds the threshold level $V_{th}$ from the temperature reference signal means. This normally high output voltage signal 69 is electrically connected through a suitable resistance 70 and isolation diode means 72 to the control circuit controlled by the exhaust gas sensor. The function of the high voltage signal 69 from the output of the comparator 22 is to clamp or restrict the operation of the exhaust gas sensor control circuit 12.

The storage means 16 and the storage discharge means 18 operate together in such a manner to be similar to an asymmetrical integrator. In such an operation the charging rate of the capacitor 48 and the discharging rate of the capacitor are two different rates. In the preferred embodiment the discharge rate of the capacitor 48 is much longer than the charging rate of the capacitor.

Figure 3:
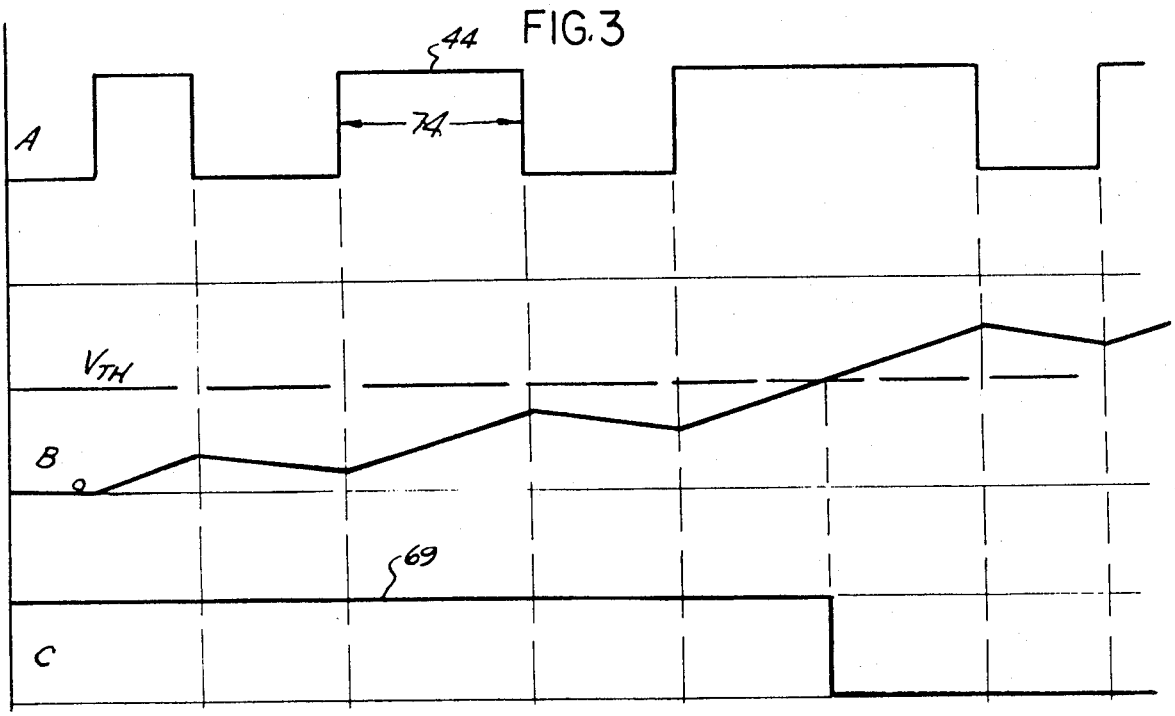
FIG. 3 is a diagram of the voltage waveforms at points A, B, and C of FIG. 2.

Referring to FIG. 3, the three voltage waveform shapes are those of positions A, B, and C of FIG. 2. Voltage waveform A, is the output voltage signal 44 of the first comparator 36 and is a rectangular wave having two voltage levels. The time of the pulse width 74 is a function of the output of the exhaust gas sensor 10. Voltage waveform B illustrates the charging of the storage means and is taken at the collector of the discharge means. Also seen when the output signal 44 of the first comparator 36 is high the charging rate of the capacitor 48 is fast compared to the discharging rate of the capacitor when the output voltage signal of the comparator 36 is low.

Thus, as illustrated in FIG. 3, waveshape B, the capacitor 48 will charge up to the value $V_{th}$ of the threshold value representing temperature. The voltage waveshape C is the waveshape of the output signal 69 of the second comparator 22 and illustrates that when the voltage on the capacitor 48 exceeds the threshold voltage $V_{th}$ formed by the temperature level reference means 20 the output signal 69 of the comparator 22 switches from a high voltage or disabling signal to a low voltage or enabling signal.

As previously indicated the output of the typical oxygen gas sensor as used in the fuel management system exceeds 600 millivolts in the presence of an exhaust gas resulting from a rich fuel mixture to a level approximately 75 millivolts in an exhaust gas mixture resulting from a lean fuel mixture. If the temperature of the sensor falls below the normal operating temperature the output of the first comparator 36 is driven low and allows the capacitor 48 to discharge through the discharge means 18 actually driving the output of the second comparator 22 to a high signal or clamping signal. An example of the comparators used are National Semiconductor Corporation's LM 2901 comparators.

In the normal operating temperature range, when the voltage output of the sensor 10 is at its first voltage signal or nominally 800 millivolts, the emitter of the transistor 26 is also at a high signal level. This high signal level results in a low voltage level output from the comparator 36 and a high level output signal from the comparator 22.

There has thus been shown and described a detection system for detecting when the temperature of an exhaust gas sensor 10 is within its normal operating range. When the temperature of the sensor is below its operating range the output of the system is a voltage signal which is used to control the operation of the exhaust gas sensor control sensor circuit 12, as applied to a fuel injection electronic control system.

I claim:

1. In a fuel management system for an internal combustion engine having an exhaust gas sensor for supplying a control signal to the fuel management control, a detection system for detecting when the temperature of the sensor is at its operating temperature to provide an enabling signal to the fuel management control system, said system comprising:

an exhaust gas sensor operable at a high sensor temperature for generating a first voltage signal in response to the absence of a predetermined constituent gas in the exhaust gas and for generating a second voltage signal in response to the presence of the predetermined constituent gas in the exhaust gas, said sensor having an internal impedance varying inversely with the temperature of said sensor from a very high impedance at its low, nonoperable temperature to a very low impedance at its high operating temperature;

an exhaust gas sensor amplifier circuit means electrically connected to said sensor, the output signal of said circuit means normally having a first voltage level when said sensor's internal impedance is very high corresponding to the low temperature of said sensor and said circuit means adapted to switch said output signal between said first voltage level and a second voltage level in response to said first and second voltage signals from said sensor;

storage means electrically responsive to said first voltage level from said circuit means for storing at a predetermined charging rate a voltage magnitude representing the temperature of said gas sensor;

storage discharge means electrically connected to said storage means and operable for discharging said storage means at a predetermined discharging rate, in response to said second voltage level from said circuit means;

temperature reference signal means for generating a threshold voltage level representing the normal operating temperature of said sensor; and a comparator having one input electrically connected to said storage means and another input electrically connected to said temperature reference signal means, the output of said comparator being an enabling signal when the magnitude of the voltage level of said storage means is greater than said threshold voltage level.

2. In a fuel management system according to claim 1 wherein said exhaust gas sensor is a sensor for sensing the presence of oxygen in the exhaust gas of the internal combustion engine, said sensor at its operating temperature generating said first voltage signal in the absence of oxygen representing a rich fuel mixture and generating said second voltage signal in the presence of oxygen representing a lean fuel mixture.

3. In a fuel management system according to claim 2 wherein said operating temperature is greater than 600°F and the threshold voltage level from said temperature reference signal means is intermediate said high and said low voltage level of said exhaust gas sensor amplifier circuit means.

4. In a fuel management system according to claim 1 wherein said storage means comprises:

a resistor electrically connected at one end to the output of said exhaust gas sensor amplifier circuit means and a capacitor electrically connected between the other end of said resistor and a reference voltage level, said resistor for controlling the charging current to said capacitor thereby regulating the charging rate of said capacitor.

5. In a fuel management system according to claim 4 wherein said storage discharge means comprises:

a constant current source;

a transistor having its base lead electrically connected to said constant current source and its input circuit electrically connected to said storage means and its output circuit electrically connected in circuit to a reference voltage level;

said constant current source supplying sufficient base current to said transistor for controlling the discharge rate of said storage means through said input-output circuit of said transistor.

6. In a fuel management system according to claim 5 wherein said charging rate is substantially greater than said discharging rate.

7. In a fuel management system according to claim 1 wherein said internal impedance of said sensor at its low, nonoperable temperature is approximately 100 megohms and said internal impedance of said sensor at its operating temperature is approximately 1000 ohms

* * * * *

UNITED STATES PATENT OFFICE

CERTIFICATE OF CORRECTION

PATENT NO. 3,938,479

DATED February 17, 1976

INVENTOR(S) Allan L. Oberstadt

It is certified that error appears in the above-identified patent and that said Letters Patent are hereby corrected as shown below:

Column 5, line 35, before "circuit" insert the word ---control---.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*